United States Patent [19]

Nagatani et al.

[11] Patent Number: 4,551,367

[45] Date of Patent: Nov. 5, 1985

[54] PACKAGED PHOTOGRAPHIC PRODUCT

[75] Inventors: Toshio Nagatani; Norio Chiba; Takao Hatanaka; Toshio Saito, all of Hino, Japan

[73] Assignee: Konishiroku Photo Industry Co., Ltd., Tokyo, Japan

[21] Appl. No.: 606,343

[22] Filed: May 2, 1984

Related U.S. Application Data

[63] Continuation of Ser. No. 273,924, Jun. 15, 1981, abandoned.

[30] Foreign Application Priority Data

Jun. 23, 1980 [JP] Japan ..... 83910

[51] Int. Cl.[4] ..... B65D 65/40

[52] U.S. Cl. ..... 428/35; 206/455; 206/328

[58] Field of Search ..... 206/445, 455, 334, 328, 206/312; 428/35

[56] References Cited

U.S. PATENT DOCUMENTS 3,958,693 5/1976 Greene ..... 206/455
4,147,291 4/1979 Akao et al. ..... 206/455
4,238,030 12/1980 Maylandt ..... 206/444
4,247,002 1/1981 Horian ..... 206/312
4,356,224 10/1982 Akao et al. ..... 206/455

*Primary Examiner*—John E. Kittle
*Assistant Examiner*—James J. Seidleck
*Attorney, Agent, or Firm*—Frishauf, Holtz, Goodman & Woodward

[57] ABSTRACT

A packaged photographic product, comprising a composite having a light-sensitive photographic material interposed between protective materials, which composite is further packaged within a barrier packaging material, said barrier packaging material having at least a metal layer provided internally and at least one layer of a polyolefin or a polyolefin derivative prepared by extrusion lamination, and said product also satisfying at least one of the conditions (a) and (b) shown below:

condition (a): the surface potential of said barrier packaging material on the side of said protective material having an absolute value of not higher than 75 V;

condition (b): the surface specific resistance of said protective material being not higher than $1\times10^{11}\ \Omega$ under the condition of the relative humidity of 60%.

7 Claims, 2 Drawing Figures

PACKAGED PHOTOGRAPHIC PRODUCT

This is a continuation of application Ser. No. 273,924 filed June 15, 1981, now abandoned.

This invention relates to a packaged photographic product comprising a light-sensitive photographic material packaged within a packaging material, which is prevented from generation of static trouble occurring under packaged state and at the time of opening a package.

A light-sensitive photographic material using a synthetic resin film as a support is prone to static trouble caused by charging and discharging of static electricity, and there have been various developments of technology for improvement of antistatic properties of light-sensitive photographic materials per se. To the best knowledge of the present inventors, however, no antistatic technique has been known for a packaged photographic product, which is liable to suffer frequently from static trouble occurring under the packaged state or at the time of opening the package. First, this point is described below.

Light-sensitive photographic materials, typically light-sensitive silver halide photographic materials, have been produced and used in a large amount and with a variety of kinds. Concurrently with such developments, there is at present an increasing generation of static marks, which are said to be typical trouble of light-sensitive photographic materials.

In order to prevent light-sensitive photographic materials from generation of static marks, there have been made various attempts to apply antistatic treatment on a light-sensitive photographic material and to control air conditions at the time of packaging such as humidity within an appropriate range, or others. However, the static mark trouble cannot perfectly be prevented unless a large amount of antistatic agents are used. This will cause, on the contrary, other troubles such as generation of fogging unnecessary for light-sensitive photographic materials or deterioration in storability. For this reason, it is practically difficult to prevent generation of static mark trouble by improvement of light-sensitive photographic materials alone.

Further, even when static mark troubles are tried to be gotten rid of by application of such an antistatic treatment on a light-sensitive photographic material as mentioned above, it is really impossible to completely avoid static mark troubles. Thus, there have been made further investigations for causes of such troubles with due considerations about barrier packaging. As a consequence, when the inner side of a barrier packaging is prepared by extrusion lamination, a new cause for generation of static marks is found to be inherently present. In this invention, the new static trouble is referred to as package-opening static trouble, since it occurs most frequently at the time of opening packages.

Extrusion lamination is the most economical method, for which a great extent of decrease of production cost as well as of material cost can be expected, since it is not necessary to prepare resin films in advance, as required in case of adhesive lamination. When a photographic packaging material such as a barrier packaging is prepared by extrusion lamination, however, there is a serious static trouble.

Moreover, when a barrier packaging material comprises a metal layer such as aluminium and a dielectric layer such as a polyolefin laminated onto each other, it has been found by the present inventors that frequency of generation of static marks is noticeably increased after packaging with such a barrier packaging material. This may be considered to be due to the fact that a resin such as a polyolefin is charged on extrusion through a die and directly laminated onto a web having a metal layer such as of aluminium, whereby the charges can difficultly be discharged and remain semi-stably on the layer of a polyolefin, etc.

Referring to the package-opening trouble, packaged photographic products, for example, those of light-sensitive photographic materials for X-ray, are generally constituted of plural sheets of light-sensitive photographic materials interposed between protective materials (photographic packaging materials generally called card boards, which are packaging materials disposed innerside of a barrier bag or at the outer side of a photographic material principally for the purpose of protection of the light-sensitive photographic material from external pressure or prevention thereof from bending; and they are hereinafter referred to as card boards), said card boards being packaged, each for said plural sheets of photographic materials to be packaged, within barrier packaging materials. Photographic packaging materials, of which those fabricated into bags, are called barrier bags said barrier bags are provided principally for the purpose of separating the atmosphere in said bags from the atmosphere outside of said bags. Said bags are generally constituted of a synthetic resin composite material having a metal layer, sometimes being also endowed with light-shielding property). In some cases, there may also be interposed a sheet material called an interleaf between the card board and the light-sensitive photographic material.

The package-opening static trouble may be considered to be caused by a friction between the barrier bag and the card board, when taking out the light-sensitive photographic material protected with the card board from the barrier bag as well as by induction of charges of opposite polarity on the card board by the charges present on the inner surface of the barrier bag, followed by discharging of said charges from the card board on the light-sensitive material, when withdrawing the light-sensitive photographic material from the card board, to thereby generate static marks thereon. Even when a spacer paper may be present, discharging from the card board to the spacer paper or from the interleaf to the light-sensitive material will result in appearance of static marks.

Thus, for prevention of the package-opening static trouble, it is required to apply an antistatic treatment on a packaging material.

In the prior art, antistatic treatment has not been applied on a barrier packaging material or on a card board, since neither presence of a package-opening static trouble nor the mechanism for generation thereof had not been known. Only quite recently, an antistatic treatment is applied on a spacer paper for the purpose entirely different from that of a present invention. The present inventors have discovered the presence of a package-opening static trouble, further investigated the causes therefor and have finally succeeded in analysis of the mechanism for generation thereof to accomplish the present invention.

The term "polyolefin" herein mentioned is inclusive of a low density polyethylene, a medium density polyethylene, a high density polyethylene, polypropylene and others, while the term "polyolefin derivative" including ionomer resins, EVA (Ethylene Vinyl Acetate) resins, etc. When the above resin is extruded through a die, static charging will occur more noticeably if the resin comprises fillers such as carbon black or metallic powders therein. With such a resin, package-opening static trouble will be more liable to occur. Thus, the "polyolefin" and the "polyolefin derivative" herein mentioned are also inclusive of those comprising various fillers.

As has already been clarified, the first object of the present invention is to provide a packaged photographic product comprising a light-sensitive photographic material packaged within a packaging material, which is prevented from generation of static charging trouble such as package-opening static troubles.

The second object of the present invention is to provide a packaged photographic product prevented from generation of static charging troubles, when using a barrier packaging material provided with a polyolefin layer or a polyolefin derivative layer through extrusion lamination having various characteristics as mentioned above.

Other objects of the present invention will become apparent as the following description proceeds in the specification.

SUMMARY OF THE INVENTION

The above objects of the present invention can be accomplished by a packaged photographic product, comprising a composite having light-sensitive photographic material interposed between protective materials (card boards), which composite is further packaged within a barrier packaging material, said barrier packaging material having at least a metal layer provided internally and at least one layer of a polyolefin or a polyolefin derivative prepared by extrusion lamination, and said product also satisfying at least one of the conditions (a) and (b) shown below:

condition (a): the surface potential of said barrier packaging material on the side of said card board having an absolute value of not higher than 150 V;

condition (b): the surface specific resistance of said protective material being not higher than $1\times10^{11}\Omega$ under the condition of the relative humidity of 60%.

The surface potential on the inner surface of the barrier bag can be maintained at an absolute value not higher than 150 V. For instance, the following method may be adopted. That is, for example, no charging should be effected during preparation of the barrier packaging material and air-conditioning as well as discharging should properly be conducted. For the purpose of avoiding charging, it is necessary to adapt the charge series on the innerside and the outerside of the barrier packaging material to coincide with each other, since frictional and/or peel-off charging occurs between said innerside and outerside of the barrier packaging material during winding or unwinding of the web and the barrier packaging material. So far as discharging is concerned, such an effect may be expected by use of a self-discharging type discharger, an alternate-current discharger or ionic radiation type discharger at the time of extrusion. Further, for complete discharging, an antistatic agent may be incorporated in at least one layer inside than the metal layer such as of aluminium to give a more favorable result, whereby the absolute value of surface potential on the innerside of the barrier bag can uniformly be made to be not higher than 150 V.

Figure 1:
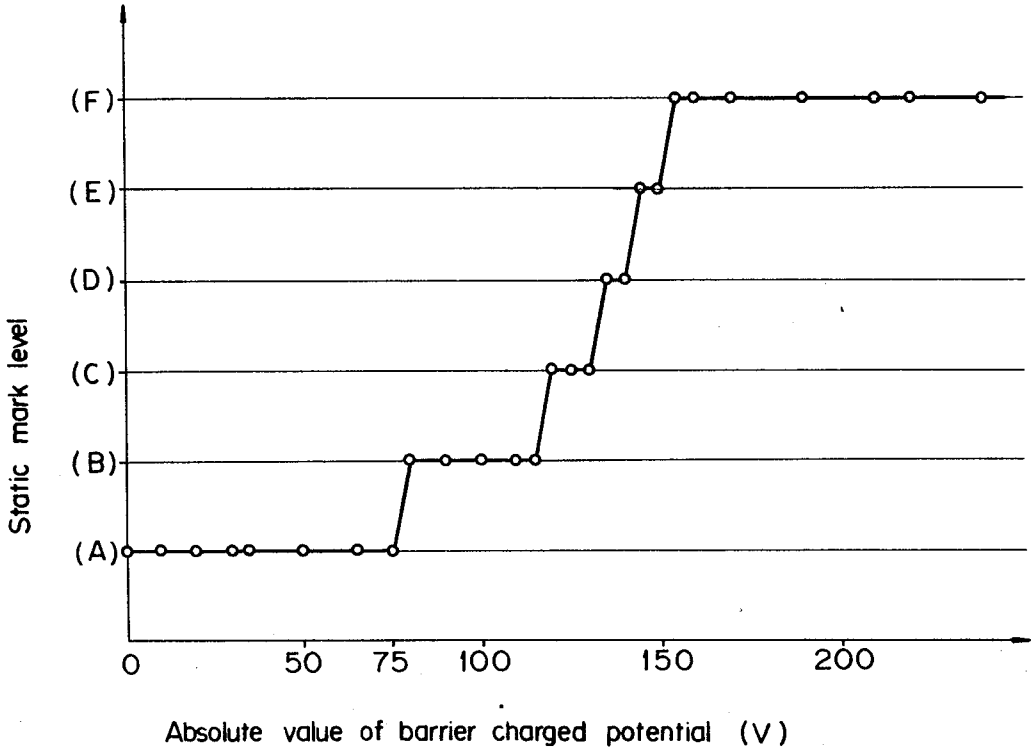
FIG. 1 is a graph depicting the relationship between (1) the absolute value of the surface potential of the barrier packaging material and (2) the static mark level representing the percentage of the area marked by static.

Referring now to the antistatic agent as mentioned above, the antistatic agent to be internally used in the barrier packaging material may either be nonionic, cationic, anionic or zwitterionic. Typical effective nonionic antistatic agents may include higher alcohols containing added ethylene oxide units, alkyl phenols containing added ethylene oxide units, esters (e.g. esters of higher fatty acids with polyvalent alcohols, polyethyleneglycolic esters of higher fatty acids, etc.), polyethers, amides (e.g. higher fatty acid amides, dialkyl amides, higher fatty acid amides containing added ethylene oxide units), etc.

As anionic antistatic agents, there may preferably be employed alkylaryl phosphonic acid, adipic acid, glutamic acid, alkyl sulfonates, alkyl sulfates, polyoxyethylene alkyl phosphate, fatty acid salts, alkylbenzene sulfonates, alkylnaphthalane sulfonates and sodium dialkylsufosuccinate.

Cationic types may be exemplified preferably by amines (e.g. alkyl amine phosphates, Schiff base, amide amine, polyethylene imine, complex of amide amine and metal salt, alkyl ester of amino acid, etc.), imidazolines, amine-ethylene oxide adduct, quaternary ammonium salt, and so on.

Zwitterionic types may preferably be N-acylsarcosinate, aminocarboxylic acid derivatives, alanine type metal salt, an imidazoline type metal salt, a carboxylic acid type metal salt, a dicarboxylic acid type metal salt, a diamine type metal salt, a metal salt having ethylene oxide groups.

There may also be used other substances not belonging to the above categories such as inorganic electrolytes, metallic powders, metal oxides, kaoline, silicates, carbon powders, carbon fibers, etc. Alternatively, graft polymerization or polymer blend may also effectively be employed.

As the antistatic agent to be employed externally on the barrier packaging material in the present invention, there may be mentioned anionic types, including carboxylates, sulfuric acid derivatives (e.g. alkyl sulfonates), phosphoric acid derivatives (e.g. phosphonic acid, phosphoric acid ester, etc.), and polyester derivatives.

The cationic type antistatic agents may include amines (e.g. alkyl amines, amide amines, ester amines, etc.), vinyl nitrogen derivatives, quaternary ammonium salts (e.g. ammonium salts containing amide groups, ammonium salts containing ethylene oxides etc.), acrylic acid ester derivatives, acrylic acid amide derivatives, vinyl ether derivatives, and so on.

As the nonionic type, there may preferably be used polyvalent alcohols (e.g. glycerine, sorbitol, polyethylene glycol, polyethylene oxide, etc.), polyvalent alcohol ester, higher alcohol-ethylene oxide adducts, alkyl phenol-ethylene oxide adducts, fatty acid-ethylene oxide adducts, amides, amide-ethylene oxide adducts, amine-ethylene oxide adducts, etc. As the amphoteric agents, there may preferably be used carboxylic acids (e.g. alkyl alanine), sulfonic acids, etc.

The inner surface may also be coated with water, an inorganic electrolyte solution a polar solvent such as a lower alcohol, or a water-soluble polymer to achieve the object of the invention. Alternatively, a metal complex salt or a silicon compound may also be used as the antistatic agent for the barrier packaging material. Furthermore, there may also be applied an acid treatment, a flame treatment or corona discharge treatment, whereby similar effects can be expected to be obtained.

As the antistatic agents to be employed for the barrier packaging material, irrespect of whether they are internally or externally employed as mentioned above, there may be employed a variety of species in an amount, which may vary depending on the antistatic agent employed, of at least 500 ppm, preferably 1,000 ppm in case of internal incorporation, up to 10,000 ppm in case of an inorganic type or up to 200,000 ppm in case of an inorganic type, especially carbon black, whereby the object of the present invention can be achieved. Of course, said range is not limitative, but there may be employed an amount exceeding the lower and/or upper limits.

While the object of the present invention can be achieved so far as the surface potential on the barrier packaging material on the side of the card board is controlled at not higher than an absolute value of 150 V, the surface potential level may sometimes be desired to be not higher than an absolute value of 75 V, depending on the conditions for handling of the packaged photographic product according to the present invention or the external atmospheric conditions (see Examples as hereinafter described).

In the following, the condition (b) of the present invention is to be explained.

The object of the present invention can also be achieved by controlling the surface specific resistance of the card board to $1\times10^{11}\Omega$ or less under the condition of the relative humidity of 60%. Under said condition, the charges generated or accumulated on the card board during manufacturing steps (for example, during conveying by means of an automatic packaging machine) or handling by the consumers can rapidly be reduced. This condition can be accomplished by incorporating or impregnating the card board with, for example, an inorganic compound to impart electroconductivity thereto. As an inorganic compound to be incorporated in the card board of the present invention, there may be employed any compound. Typical examples of the inorganic compounds preferably used in the present invention may include inorganic salt compounds, comprising a salts of at least one element selected from, for example, lithium, sodium, potassium, magnesium, calcium, lead, iron, copper, zinc, aluminium, tin, strontium and manganese. Among them, those which are particularly preferred from the aspects of the effect obtained as well as economy are hydrochlorides such as sodium chloride, potassium chloride, magnesium chloride, calcium chloride, iron chloride and copper chloride; nitrates such as potassium nitrate, magnesium nitrate, lead nitrate and zinc nitrate; sulfates such as sodium sulfate, aluminium sulfate, magnesium sulfate and iron sulfate; phosphates such as potassium hydrogen phosphate and sodium phosphate; borates such as potassium borate; and bromides such as sodium bromide and lithium bromide. The above-mentioned compounds may have crystal water.

These inorganic (salt) compounds can be applied on the card board according to any method. Typically, however, at the time of sheet making, paper sheets can be impregnated with an aqueous inorganic salt compound by dipping therein.

These inorganic compounds may be employed preferably in an amount of 0.1 to 20 mg per 100 $cm^2$ of the card board. With an amount less than 0.1 mg/100 $cm^2$, no sufficient antistatic effect can be obtained. On the other hand, an amount in excess of 20 mg/100 $cm^2$ may cause adhesion between the card board and the light-sensitive material or an unnecessary fogging.

Of the aforesaid conditions (a) and (b), at least one should be satisfied to enable reduction in static troubles such as package-opening static trouble. Further, when both conditions are satisfied, there can be obtained a more favorable result.

As the light-sensitive photographic materials for which the present invention can be applied to give appreciably good effects, there may be mentioned light-sensitive silver halide photographic materials (e.g. for direct X-ray, indirect X-ray, printing, color photography, films for contact and photographic printing papers), diffusion transfer films, films for atomic nucleus, films for blue prints, potassium bichromate photography or diazo photography, photosensitive resins, etc.

By satifying the condition (a) and/or the condition (b) according to the present invention, in addition to extreme reduction in package-opening static trouble, the following effects can also be expected:

(1) When the card board is withdrawn from the barrier bag at the time of package opening of the barrier bag, the difficulty in withdrawal due to static attraction is relieved.

(2) Static shock imparted to workers is obviated.

(3) The consumers are not required to have special air-conditioning equipment for prevention of package-opening static troubles.

(4) The manufacturers can enjoy the benefit of being free from discharging from the web at the time of high speed conveying of the barrier packaging material.

(5) The manufacturers can expect decrease in manufacturing cost as well as increase in production amount, since it is rendered possible to perform a high speed packaging.

(6) The manufacturers can dispense with precise control of air-conditioning, because air-conditioning can be operated within broadened range for appropriate control without causing static troubles.

(7) Reduction of pressure in the barrier bag is the indispensable method for prevention of scratches or breaking during transportation, but it may disadvantageously increase the tendency to generate package-opening static troubles. Whereas, the packaged product according to the present invention can be prevented from package-opening static troubles even when brought into reduced pressure.

(8) Use of an antistatic agent as one means for achieving the object of the present invention is the method most inexpensive as to both operational cost and material cost. In whatever form the barrier packaging material may be stored (for example, in a roll), the charges generated in the step for preparation of the barrier packaging material can rapidly be attenuated.

(9) The fact that the present invention can be achieved by the condition (b) for the card board means that the practice of the invention is very easy, since it is only required as one method to incorporate an antistatic agent therein. For example, when sodium chloride is used in an amount of 1 mg/100 $cm^2$, the electroconductivity of the card board is $8\times10^{10}\Omega$ in terms of surface specific resistance under the conditions of 23° C. and 60% RH, whereby the attenuation time for the charges decreasing from 10 V to 1 V being 3 seconds.

The present invention is further illustrated by referring to the following Examples, by which the embodiments of the present invention are not limited.

First, the contents of the experiments in the following Examples and the evaluation methods are to be explained. The barrier packaging material was prepared by permitting polyethylene molten at high temperatures to flow out through an extruder, which was in turn used for coating on an aluminium foil (9μ) in a certain film thickness. As the card board, there was employed a paper board. As to the samples containing antistatic agents, they were prepared by previously kneading antistatic agents into polyethylene, followed by dilution with polyethylene under molten state to obtain a desired concentration.

Measurement of charged voltage was conducted using a vibration capacity type surface potentiometer (Model SSV-II-30, produced by Kawaguchi Denki Co.). The surface specific resistance was measured by means of a superinsulation resistance tester (Model VE-30, produced by Kawaguchi Denki Co.). These measurements were carried out in a room conditioned at the relative humidity of 60%, at 23° C.

The materials for packaging used in the samples were arranged as follows. Fifty sheets of light-sensitive photographic materials (conventional X-ray films were used in the present Examples) were superposed on each other, and the resultant whole assembly was wrapped within a spacer paper. The card boards were placed on the outside of the wrapped assembly and further packaged in a barrier bag, being evacuated to 380 mmHg, to provide a packaged sample. As to the package-opening method, each package was opened, after leaving the above bag-shaped packaged sample at 23° C. for one week, by cutting open one side of the package, withdrawing the contents together with the card boards, followed by taking out the light-sensitive photographic materials and subsequently by measurement of the potential on the barrier packaging material, and further developing the light-sensitive photographic materials for determination of the static marks generated. All of said operations were conducted in a dark room.

The evaluation of static marks was conducted in the following manner. First, there was prepared films on which static marks had previously been generated and the darkened areas on respective films were measured. The evaluation was conducted by comparison with these films. In the present invention, the static marks were rated as follows:

A . . . no generation

B . . . less than 0.1% of static mark area based on the total film area

C . . . 0.1% to less than 1% of the static mark area based on the total film area D . . . 1% to less than 5% of the static mark area based on the total film area E . . . 5% to less than 10% of the static mark area based on the total film area F . . . 10% or more of the static mark area based on the total film area.

The experiments were carried out several times, and the evaluation is given on an average, when different evaluations were obtained.

EXAMPLE 1

Table 1 shows the results of experiments about the effects of the antistatic agents in relation to the changes in constitution of the barrier packaging materials, based on the aforesaid experimental contents and the measuring methods.

As apparently seen from Table 1, the object of the present invention can be evidenced exemplarily by the item specified by the condition (a). Further, the aluminium layer, which is prone to package-opening static trouble irrespective of whether it may be an aluminium foil or a vapor-deposited aluminium, can be controlled to be free from the package-opening static trouble by satisfying the condition (a) of the present invention.

EXAMPLE 2

FIG. 1 shows the result of further investigation about the relation between the barrier packaging material and the package-opening static mark, that is, FIG. 1 is a graph showing the relationship between the absolute value of the barrier packaging material and the static mark level.

The barrier packaging material used in this Example comprises a craft paper (70 g/$m^2$)/LDPE (15μ)/Al foil (9μ)/LDPE (50μ).

As the card board, there was used a conventional paper board ($1\times10^{13}\Omega$ at 23° C., 60% of relative humidity).

As apparently seen from FIG. 1, the effect of the present invention will appear by critically suppressing the absolute value of the surface potential of the barrier packaging material to not higher than 150 V.

TABLE 1

| Sample No. | Constitution of barrier bags innerside of aluminium layers | Charged voltage on barrier (V) | Static marks |
|---|---|---|---|
| 1 | Al foil/LDPE (50μ) | −170 | F |
| 2 | Al foil/LDPE + carbon black | −380 | F |
| 3 | Al foil/LDPE + antistatic agent I | <±10 | A |
| 4 | Al foil/LDPE + antistatic agent II | −40 | A |
| 5 | Al foil/LDPE + antistatic agent III | <±50 | A |
| 6 | Al layer/LDPE (vapor deposition) | | |
| 7 | Al layer/LDPE + carbon black (vapor deposition) | −350 | F |
| 8 | Al layer/LDPE + antistatic agent I (vapor deposition) | <±10 | A |
| 9 | Al layer/LDPE + antistatic agent II (vapor deposition) | −65 | A |
| 10 | Al layer/LDPE + antistatic agent III | <±30 | A |

TABLE 1-continued

| Sample No. | Constitution of barrier bags innerside of aluminium layers | Charged voltage on barrier (V) | Static marks |
|---|---|---|---|
| | (vapor deposition) | | |

Notes:
(1) All the antistatic agents are added in amounts of 1000 ppm; (2) carbon black is dispersed in an amount of 5 wt. %; (3) the symbol "LDPE" means low density polyethylene; (4) the card board used is not pre-treated and has a resistance value of $1 \times 10^{13}$ Ω when measured at 23° C., 60% relative humidity; (5) the antistatic agent I is a nonionic ester type, glycerin monostearate, II a nonionic type, polyethylene glycol, and III an anionic type, sodium alkylbenzene sulfonate.

EXAMPLE 3

Table 2 shows the results of the extents of static marks depending on the changes in the added layer using the antistatic agent I. In Table 2, the sample having a three-layered constitution is prepared by extrusion coating of the layer contacted with the aluminium layer, followed further by lamination thereon of a polyethylene film previously prepared.

As apparently seen from Table 2, the layer containing the antistatic agent can be effective when it is provided at the innerside of the aluminium layer.

EXAMPLE 4

Table 3 shows various amounts of the antistatic agent I (as described in Example 1) and various surface potentials of barrier packaging materials, together with the resulting extents of static marks.

The constitution of the barrier packaging material is the same as that used in Example 2.

As apparently seen from Table 3, incorporation of an antistatic agent can effectively prevent static marks to achieve readily the condition (a) of the present invention. The effect can be recognized at a level of addition of 500 ppm or more, preferably 1,000 ppm or more.

EXAMPLE 5

Figure 2:
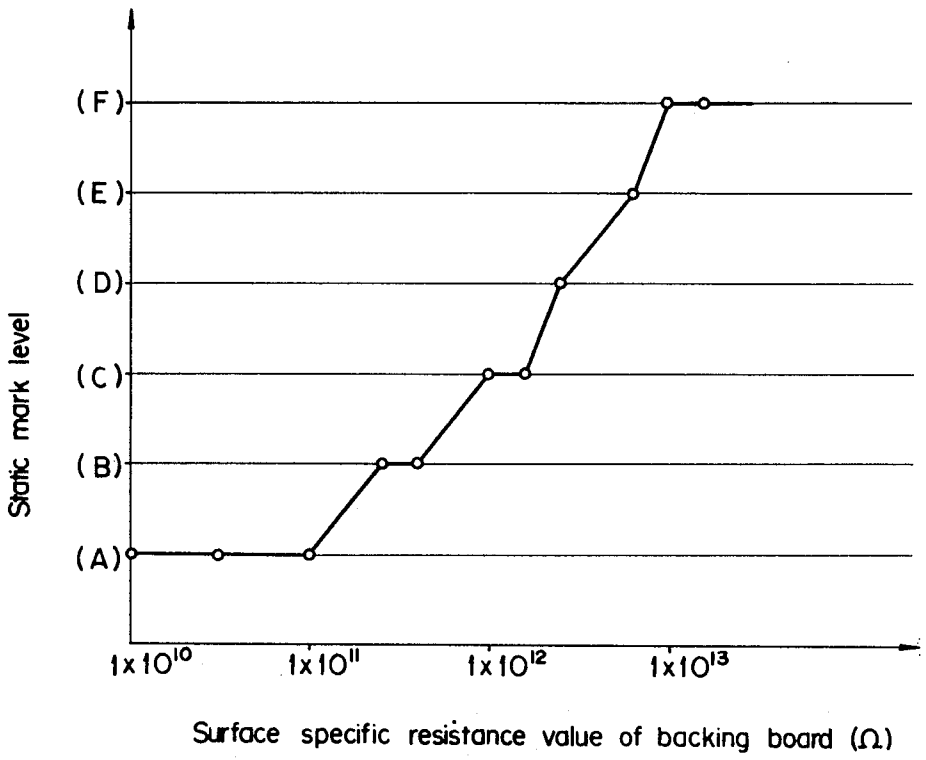
FIG. 2 is a graph depicting the relationship between (1) surface specific resistance of the cardboard and (2) the static mark level representing the percentage of the area marked by static.

FIG. 2 shows the results when the surface specific resistance value of the card board was varied, while maintaining the charged voltage on the barrier packaging material at a constant value, that is, FIG. 2 is a graph showing the relationship between the surface specific value of the card board and the static mark level.

The card boards with different surface specific resistance values were prepared by dipping them into aqueous NaCl solutions.

TABLE 2

| Sample No. | Constitution of barrier innerside of aluminium | Charged voltage on barrier (V) | Static marks |
|---|---|---|---|
| 11 | Al foil/LDPE (50μ) | −180 | F |
| 12 | Al foil/LDPE (30μ) | −160 | F |
| 13 | Al foil/LDPE (15μ)/LDPE (35μ) + antistatic agent I | <±50 | A |
| 14 | Al foil/LDPE (15μ) + antistatic agent I/LDPE (35μ) | <±80 | B |
| 15 | Al foil/LDPE + antistatic agent I (50μ) | <±50 | A |

(1) The antistatic agents used are the same as the antistatic agent I in Example 1, being added all in amounts of 500 ppm;
(2) The card boards used are conventional paper boards (having a surface specific resistance of $1.0 \times 10^{13}$ Ω).

TABLE 3

| Sample No. | Amount of antistatic agent (ppm) | Surface potential of barrier bag (V) | Static marks |
|---|---|---|---|
| 11 | 0 | −180 | F |
| 16 | 500 | <±80 | B |
| 17 | 800 | <±80 | B |
| 18 | 1000 | <±30 | A |
| 19 | 2000 | " | A |
| 20 | 3200 | " | A |

TABLE 3-continued

| Sample No. | Amount of antistatic agent (ppm) | Surface potential of barrier bag (V) | Static marks |
|---|---|---|---|
| 21 | 4000 | " | A |
| 22 | 5000 | " | A |
| 23 | 10000 | " | A |

We claim:

1. A packaged photographic product, comprising a composite having a light-sensitive photographic material interposed between protective materials, which composite is further packaged within a barrier packaging material, said barrier packaging material having at least a metal layer provided internally and at least one layer of a polyolefin or a polyolefin derivative prepared by extrusion lamination, and said product also satisfying at least one of the conditions (a) and (b) shown below:

condition (a): the surface potential of said barrier packaging material on the side of said protective material having an absolute value of not higher than 25 V;

condition (b): the surface specific resistance of said protective material being not higher than $1 \times 10^{11}$Ω under the condition of the relative humidity of 60%.

2. A packaged photographic product as claimed in claim 1, wherein said product satisfies the condition (a).

3. A packaged photographic product as claimed in claim 2, wherein an antistatic agent is incorporated in the surface layer of the polyolefin or polyolefin derivative, either internally or externally.

4. A packaged photographic product as claimed in claim 1, wherein said product satisfies the condition (b) and the protective material is incorporated with an inorganic compound.

5. A packaged photographic product as claimed in claim 4, wherein the inorganic compound is selected from the salts of lithium, sodium, potassium, magnesium, calcium, lead, iron, copper, zinc, aluminium, tin, strontium and manganese.

6. A packaged photographic product as claimed in claim 5, wherein the inorganic compound is selected from the salts of sodium, potassium, magnesium, calcium, iron and copper.

7. A packaged photographic product as claimed in claim 4, 5 or 6, wherein the amount of the inorganic compound to be incorporated in a sheet of protective material is in the range of 0.1 to 20 mg/100 $cm^2$.

* * * * *